United States Patent [19]

Fukui et al.

[11] Patent Number: 4,909,151

[45] Date of Patent: Mar. 20, 1990

[54] METHOD OF FORMING AN INK IMAGE AND PRINTING THE FORMED IMAGE

[75] Inventors: Yasuo Fukui, Kadoma; Masahide Tsukamoto, Nara; Yutaka Nishimura, Kadoma, all of Japan

[73] Assignee: Matsushita Electric Industrial Co., Ltd., Osaka, Japan

[21] Appl. No.: 178,647

[22] Filed: Apr. 7, 1988

[51] Int. Cl.[4] ..... B41M 5/00

[52] U.S. Cl. ..... 101/450.1; 101/463.1; 101/467

[58] Field of Search ..... 101/465, 466, 467, 450.1, 101/463.1

[56] References Cited

U.S. PATENT DOCUMENTS

| | | | |
|---|---|---|---|
| 3,511,178 | 5/1970 | Curtin | 101/467 X |
| 3,554,125 | 1/1971 | Van Dorn et al. | 101/467 X |
| 3,554,836 | 1/1971 | Steindorf | 101/217 X |
| 3,859,920 | 1/1975 | Ritzerfeld | 101/467 |
| 4,063,949 | 12/1977 | Uhlig et al. | 101/467 X |
| 4,086,853 | 5/1978 | Figov et al. | 101/467 X |

FOREIGN PATENT DOCUMENTS

| | | | |
|---|---|---|---|
| 39457 | 3/1983 | Japan | 101/467 |
| 193154 | 11/1983 | Japan | 101/467 |
| 271741 | 11/1987 | Japan | 101/450.1 |
| 1091501 | 11/1967 | United Kingdom . | |

OTHER PUBLICATIONS

"Balance between Damping Water and Ink" by Mutsuo Kobayashi in Japan Printer, vol. 69, No. 5, pp. 31 to 36, 1986.

"Dry Lithography" by Tsuguo Yamaoka in Japan Printer, vol. 60, No. 2, pp. 9 to 17, 1977.

*Primary Examiner*—Clifford D. Crowder

*Attorney, Agent, or Firm*—Wenderoth, Lind & Ponack

[57] ABSTRACT

A method of forming an ink image with a thermo-sensitive ink by using a printing plate that is used in dry lithographic printing, and printing the ink image onto an object. An ink remover is placed via a thermo-sensitive ink layer that is in a heated state on a printing surface of a printing plate having a part receptive to ink and a part capable of repelling ink. The printing plate and the ink remover are separated after they are cooled so that the ink layer on the part capable of repelling ink is transferred to the ink remover. The ink image obtained on the printing plate or the ink remover is transferred to an object. Printing that does not require maintenance that has been essential to conventional dry lithographic printing becomes possible.

22 Claims, 2 Drawing Sheets

METHOD OF FORMING AN INK IMAGE AND PRINTING THE FORMED IMAGE

BACKGROUND OF THE INVENTION

1. Field of the Invention

The present invention relates to a method of forming an ink image by using a printing plate that is used in dry lithographic printing, and to a method of printing the formed image.

2. Description of the Prior Art

Many problems of lithographic printing caused by the use of damping water were solved by the development of dry lithographic printing (see "Balance between Damping Water and Ink" by MUTSUO KOBAYASHI in JAPAN PRINTER, Vol. 69, No. 5, pages 31 to 36, (1986)).

The printing surface of a printing plate used in dry lithographic printing consists of image areas receptive to an ink and non-image areas capable of repelling the ink thereby allowing the ink to adhere selectively t the image areas only. Since the non-image areas require high ink releasability, they are made of a material low in surface energy such as silicone elastomers and fluorine compounds (see "Dry Lithography" by TSUGUO YAMAOKA in JAPAN PRINTER, Vol 60, No. 2, pages 9 to 17 (1977)).

Dry lithographic printing is carried out by supplying an ink to the printing surface of such a printing plate as mentioned above with an ink roller, and transferring the ink adhered on the image areas to an object. In lithographic printing, it is required to use a special ink whose viscoelasticity has been adjusted. The cohesion of the special ink is adjusted to be greater than the adhesion between the ink and the non-image areas so that the ink hardly adheres to the non-image areas.

However, in such conventional dry lithographic printing, maintenance is essential during and after the printing. That is, the ink used in dry lithographic printing will solidify due to oxidative polymerization when left in the air. Therefore, it is required to clean many parts of the printer after the printing operation. On the other hand, since several hours are required for permitting the ink transferred to the object to solidify completely, the objects cannot be placed one over another immediately after the printing, or ink offset would occur.

Further, the cohesion of the in decreases with, to an increase of the temperature. Therefore, when the temperature of the printing surface of the printing plate rises during the printing, the ink adheres to the non-image areas, resulting in scumming on the object. Consequently, it is required to monitor at al times the temperature of the printing surface of the printing plate during the printing.

SUMMARY OF THE INVENTION

An object of the invention is to provide a printing method that allows a large number of copies to be printed at low running cost at high speed, and doe not require maintenance.

To attain the above object, the present invention performs printing by the following method. An ink remover is placed via a thermo-sensitive ink layer in a heated state on the printing surface of a printing plate having a part receptive to the ink and a part capable of repelling the ink. The printing plate and the ink remover are cooled, and then separated from each other.

The ink layer on the part capable of repelling the ink is transferred to the ink remover, while the ink layer on the part receptive to the ink remains on the printing plate. The thus obtained ink image on the printing plate or on the ink remover is transferred to an object.

According to this printing method, printing using a printing plate that is used in dry lithographic printing can be carried out by using a thermo-sensitive ink. Therefore, this printing method does not require the maintenance that has been essential to the conventional dry lithographic printing.

DESCRIPTION OF THE PREFERRED EMBODIMENTS

Figure 1A:
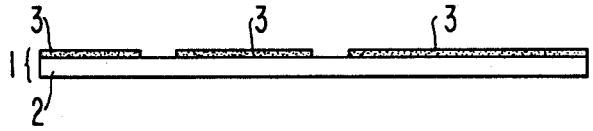
FIGS. 1 (*a*) through (*e*) are schematic sectional views for explaining printing steps in a printing method according to the present invention.
Figure 1B:
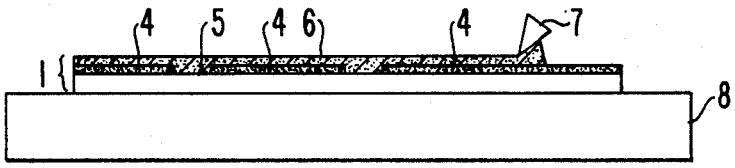
Figure 1C:
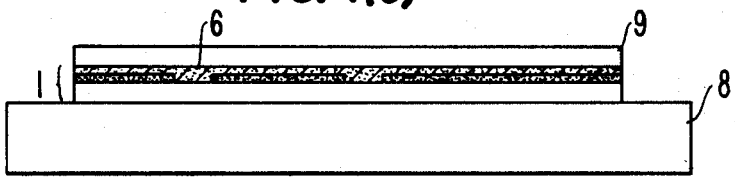
Figure 1D:
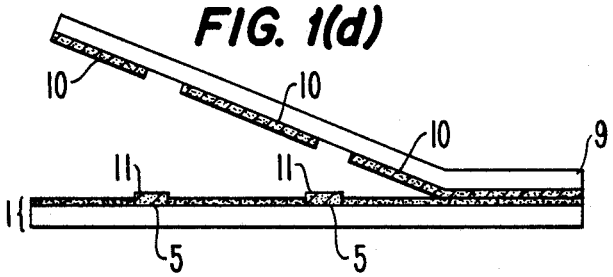
Figure 1E:
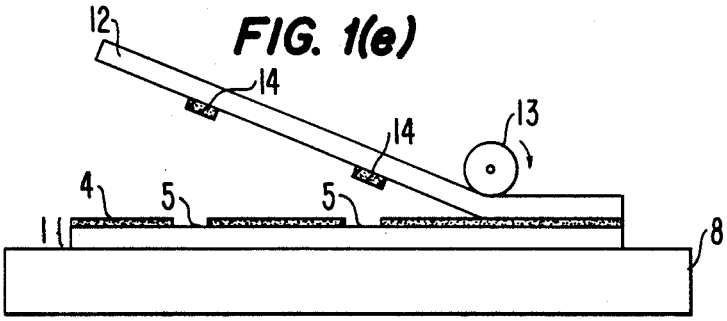

FIGS. 1 (*a*) through (*e*) are schematic sectional views of constitutional elements performing printing steps in a first printing method embodying the present invention. FIG. 1 (*a*) shows a printing plate 1 having is an ink repelling layer 3 is provided on an ink receiving body 2.

The step of supplying a thermo-sensitive ink to the printing plate 1 is shown in FIG. 1 (*b*). The printing plate 1 is heated by a metal plate 8 that has been heated. A thermo-sensitive ink is supplied onto the printing surface of the heated printing plate 1, and then a thin ink layer 6 is formed by a knife edge 7. If the viscosity of the ink is low at this moment, non-image areas 4 corresponding to the ink repelling layer 3 will repel the ink sometimes, whereas the ink adheres to image areas 5 where the ink repelling layer does not exist.

The thickness of the formed ink layer influences greatly the resolution and the image density of the ink image that will be obtained. According to a qualitative description, the resolution of an ink image that will be obtained will increase as the ink layer becomes thinner. On the other hand, the image density of the ink image that will be obtained will increase as the ink layer becomes thicker. Further, if the ink layer is excessively thick, the ink will be removed from the printing surface of the printing plate in the subsequent step with all the ink adhered on an ink remover, o that no ink image will be formed. These phenomena are related to the surface condition of the image areas and the non-image areas, the adhesive force between the ink remover surface and the ink, and the cohesion of the ink.

Then, an ink remover 9 is placed on the melted ink layer 6 as shown in FIG. 1 (*c*). At this time, it is preferable that a pressure is applied to the ink remover from the upper side by a pressure roll or the like to make the ink layer uniform. If the ink layer is made uniform this way in this step, it is not necessary to measure the amount of the ink supplied in the step of supplying the ink by using a knife edge or the like as mentioned above.

Then, the heated metal plate 8 is removed, so that the printing plate 1, the ink layer 6, and the ink remover 9 cool down. After the ink layer 6 cools down to a temperature at which the cohesion of the ink increases sufficiently, the ink remover 9 is separated from the printing plate 1 as shown in FIG. 1 (*d*). The ink on the non-image areas 4 is transferred to the ink remover 9 to become an ink layer 10 on the ink remover 9. Therefore, soiling on the non-image areas can be remarkably reduced in comparison to conventional dry lithographic printing. An important point of the present invention lies in this. That is, the formation of the ink layer is performed when the ink is in a readily flowable state, and the transfer of the ink is effected when the ink is in a highly cohesive state.

The temperature at which the release is effected depends largely on the materials and properties of the printing plate surface, the ink, and the support. For instance, when a wax ink for thermal ink-transfer printing with a softening point of 70° C. is used, the ink layer is formed as a liquid layer that is readily flowable at about 100° C., and the ink remover is separated after the ink is cooled to about 30° C. at which the ink is in a solid state high in cohesion.

When the ink remover 9 is separated as shown in FIG. 1 (*d*), the printing plate 1 having an ink layer 11 adhered to the image areas 5 of the printing plate surface will be obtained. A negative image 1 to the ink image 11 obtained on the printing plate 1 is obtained on the ink remover 9.

The ink remover 9 is separated from the printing plate 1 in such a way that the curvature of the ink remover 9 is increased as shown in FIG. 1 (*d*). By doing this, the transfer, or the adhesion, of the ink to the image areas can be stabilized. Whether the ink will be transferred to the image areas or not relates, as mentioned before, to the surfaces of the image areas and the non-image areas, the adhesive force between the ink remover surface and the ink, and the cohesion of the ink. Therefore, the curvature of the ink remover 9 relates considerably to the adhesion of the ink. If the ink remover 9 is curved with a large curvature as shown in FIG. 1 (*d*), the transfer of the ink to the printing plate 1 is effected easily.

Next, the printing plate 1 with the transferred ink image 11 is again placed on the heated metal plate 8, and an object 12 is placed on the printing plate 1, and at the same time a pressure is applied to the object 12 by a pressure roller 13 to press the object 12 to the printing plate 1 as shown in FIG. 1 (*e*). As the result, the ink 11 adhered to the image areas 5 is transferred to the object 12 thereby forming an ink image 14 on the object 12.

Alternatively, it is also possible to replace the printing plate 1 in FIG. 1 (*e*) by the ink remover 9 to obtain on the object 12 an ink image corresponding to the ink pattern 10 on the ink remover 9.

In the embodiment illustrated above, although the ink layer 6 is formed on the printing surface of the printing plate 1 by using the knife edge 7, the formation of the ink layer is not limited to that method. For instance, an ink layer may be formed on the printing surface of the printing plate by an ink roller to which an ink has been previously applied or an ink roller which has been previously impregnated with an ink. That is, any means can be used as long as a thin layer of a thermo-sensitive ink is formed. Particularly, by using a commercially available ink sheet for thermal ink-transfer printing, the supply of the ink to the printing plate surface and the placing of the ink remover can be carried out simultaneously.

In the above embodiment, although the printing plate 1 is heated by the heated metal plate 8, any means can be used to heat the printing plate. For instance, the printing plate may be heated by irradiation with heat rays, or the printing plate may be heated by hot air. Alternatively, the ink may be transferred by applying a pressure without heating. This can be readily carried out in the case wherein an ink mainly made of wax is used.

Figure 2A:
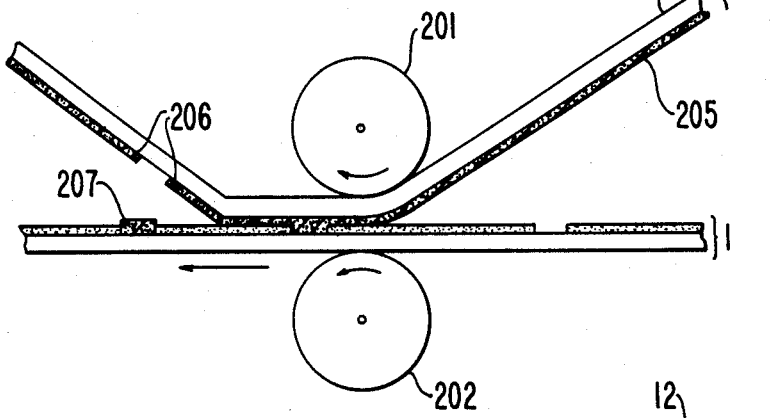
FIGS. 2 (*a*) and (*b*) are schematic sectional views for explaining printing steps in another printing method according to the present invention.
Figure 2B:
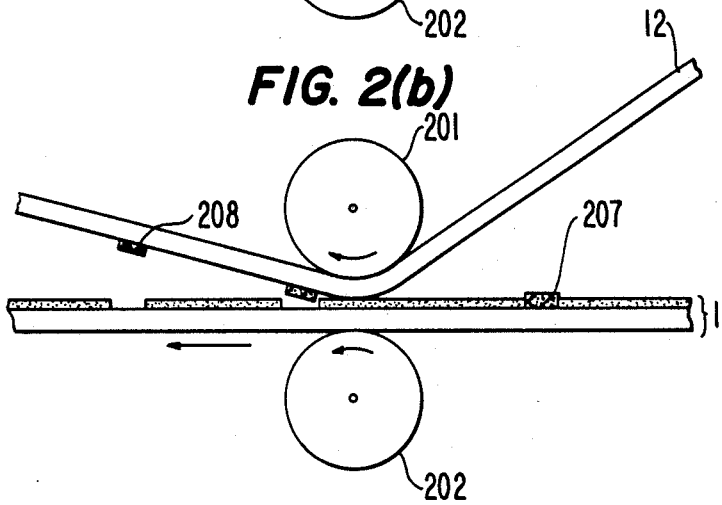

FIGS. 2 (*a*) and (*b*) show schematic sectional views of elements for performing printing steps in a second printing method embodying the present invention.

The printing plate 1 is the same as that used in the first embodiment. As shown in FIG. 2 (*a*), an ink sheet 203 having a thermo-sensitive ink layer 205 on a support 204 is bought into contact with the printing plate 1 so that the ink layer 205 comes in contact with the printing surface of the printing plate . The thus contacted ink sheet 203 and the printing plate 1 are passed between a heat roller 201 and pressure roller 202. After the printing plate 1 and the ink sheet 203 have cooled, the ink sheet 203 is separated from the printing plate 1, so that the printing plate 1 has an ink pattern 207 adhered only to the image areas of the printing plate surface.

When this printing plate 1 and an object 12 are put together and passed between the heat roller 201 and the pressure roller 202 as shown in FIG. 2 (*b*), the ink 207 adhered to the image areas of the printing plate 1 is transferred to the object 12 thereby forming an ink image 208 on the object 12.

Figure 3:
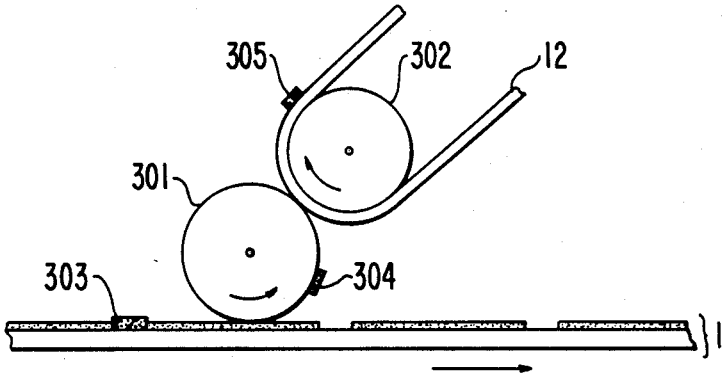
FIG. 3 is a schematic sectional view for explaining a transferring step using a transfer medium in still another printing method according to the present invention.

FIG. 3 is a schematic sectional view of elements for performing a transferring step in a third printing method embodying the present invention.

In the same manner as in the first and second embodiments, a printing plate 1 having an ink pattern 303 adhered only to the image areas of the printing plate surface is obtained. When the printing surface of the printing plate 1 is brought in contact with a transfer roller 301 that has been heated, the ink pattern 303 on the image areas is transferred to the transfer roller 301 to form thereon an ink pattern 304. When an object 12 is pressed against the transfer roller 301 by using a pressure roller 302 as shown in FIG. 3, the ink 304 pattern on the transfer roller 301 is transferred to the object 12 to form thereon an ink image 305.

Although in the above embodiment a transfer roller is used as a transfer medium, the transfer roller may be replaced by a rubber sheet in the form of a belt or a resin film to perform the same transfer effect as in the case using the transfer roller.

The construction elements used in the printing method of the present invention are not limited to those illustrated in the above embodiments.

For example, the printing plate is not limited to the construction illustrated above. An ink receiving layer may be placed on an ink repelling body, or the part receptive to an ink and the part capable of repelling the ink may be coplanar. That is, any printing plate used in dry lithographic printing may be used if it can be brought into a heated state. Exemplary usable printing plates are one wherein development is carried out using a developing solution such as a photosensitive resin plate, one wherein drawing is carried out by electric discharge or a laser beam, and one wherein plate making is carried out by mechanically forming image areas.

Although, in the above illustrated embodiments, the ink remover is a film in the form of a sheet, an endless belt or a roller, for example, may be used. Further, in order to improve the adhesion of the ink, the film may be provided thereon with a roughened layer.

Further, in the step of separating the ink remover from the printing plate, a support member for supporting the ink remover may be provided. For instance, it is possible, that the ink remover may be removed while the ink remover is moved along a support member such as a roller. By doing this, the curvature of the ink remover can be made constant thereby stabilizing the release of the ink.

Further, in the step of transferring the ink image on the ink remover or the printing plate to an object whose surface smoothness is low, a platelike heated body may be used for pressing instead of the roller. By pressing the printing plate or the ink remover and the object by a tip of a platelike heated body to bring the into firm contact with each other, a high pressure and heat can be easily applied only to a small area. Thus, it is possible to perform high quality transfer with a high resolution to an object having a low surface smoothness.

For much better understanding of the invention, the invention will now be described with reference to the following Examples.

EXAMPLE 1

An aluminum layer having a thickness of 600 Å was formed on a polyethylene terephthalate film (PET film) having a thickness of 25 μ by vacuum deposition. The aluminum layer was coated with a toluene solution of a silicone resin (KS772 manufactured by Shin-Etsu Chemical Co., Ltd.) containing a hardener (Catalyst PL-4 manufactured by Shin-Etsu Chemical Co., Ltd.) in an amount of 1% relative to the resin amount. The resin coat was hardened at 150° C. for 5 minutes to form an ink repelling silicone resin layer having a thickness of about 0.2 μ. Thus, a printing plate was produced.

The printing plate was mounted on a commercially available electric discharge recording apparatus (UA720K manufactured by NIPPON ALEPH CORPORATION), and characters were recorded on the printing plate at an applied voltage of 50 V.

The thus obtained printing plate was placed on a commercially available hot plate that had been heated to about 100° C. to heat the printing plate. A solid thermo sensitive ink comprising 3.5 weight part of carnauba wax, 3.5 weight part of paraffin wax, and 1 weight part of carbon was pressed against the printing surface of the printing plate, and the thus supplied ink layer was made to have a thickness of 10 μ by a knife edge. The viscosity of the ink was 120 cp at 100° C. There was some part of the non-image areas of the printing plate that repelled the ink, whereas the ink adhered to the image areas.

A PET film having a thickness of 12.5 μ was placed as an ink remover on the ink layer, and was pressed by a metal roller. Then, the printing plate was dismounted from the hot plate, and after the printing plate, the ink, and the ink remover cooled to room temperature (25° C.), the ink remover was separated. At that time, when the ink remover was separated from the printing plate with the printing plate kept flat and with the ink remover held to have a radius of curvature of about 1 mm, the ink that adhered to the non-image areas was transferred to he ink remover, so that the printing plate having the ink only on the image areas and no ink on the non-image areas was obtained.

On the other hand, when the printing plate was separated from the ink remover with the ink remover kept flat and with the printing plate held to have a radius of curvature of about 1 mm, all the ink was transferred to the ink remover without leaving any ink on the printing surface of the printing plate.

The above results show that the state of the curvature of the ink remover affects the mechanical relationship of the cohesion of the ink, the surface of the ink remover, and the surfaces of the image areas and the non-image areas as described before.

Further, preferably the thickness of the ink is 2 to 10 μ. When the thickness of the ink was below 2 μ, the density of the obtained ink image was low. When the thickness of the ink was over 10 μ, all the ink adhered to the ink remover, i.e., was removed from the printing plate.

EXAMPLE 2

The printing plate that was produced in Example 1 and was subjected to electric discharge recording was heated to 100° C. in the same way as in Example 1. A thermo-sensitive ink comprising 10 weight part of polyamide resin (Fuji Kasei Kogyo Co., Ltd.) and 1 weight part of carbon was supplied onto the printing plate surface, and the ink layer was made to have a thickness of about 5 μ by a knife edge. A polyethylene terephthalate film having a thickness of 25 μ was placed as an ink remover on the ink layer, and was pressed by a metal roller. The printing plate was removed from the hot plate, and after the printing plate, the ink, and the ink remover cooled to 30° C., the ink remover was separated. At that time, when the ink remover was removed from the printing plate with the printing plate kept flat and with the ink remover held to have a curvature radius of about 1 mm, the printing plate having the ink only on the image areas was obtained.

EXAMPLE 3

10 weight part of urethane resin (Crisvon 7209 manufactured by Dainippon Ink & Chemicals, Inc.), 1.5 weight part of fine silica powder, and 87.5 weight part of ethyl acetate were mixed and dispersed thoroughly, and 1 weight part of cross linking agent (Crisvon NX manufactured by Dainippon Ink & Chemicals, Inc.) was added thereto to form a coating material. A surface of a polyethylene terephthalate film having a thickness of 25 μ was coated with the coating material in an amount of 4 g/m$^2$ in terms of dried state weight to form an ink removing sheet having an almost transparent roughened layer.

Then, in a similar way to Example 1, an ink layer was formed on the printing surface of the same printing plate as that used in Example 1. The ink removing sheet was placed as an ink remover on the ink layer, and pressed by a metal roller.

Then the printing plate was removed from the hot plate, and after the printing plate, the ink, and the ink remover were cooled to room temperature (25° C.), the ink remover was separated from the printing plate with the ink remover held to have a radius of curvature of about 1 mm. As the result, the printing plate having the ink only on the image areas was obtained similarly to Example 1. In comparison to the printing plate obtained in Example 1, the printing plate obtained in this Example had a stable thickness of ink layer.

EXAMPLE 4

Aluminum was vacuum-deposited on the roughened surface of the ink removing the produced in Example 3 to form an aluminum layer having a thickness of 600 Å. The aluminum layer was coated with a toluene solution of silicone resin (KS772 manufactured by Shin-Etsu Chemical Co., Ltd.) containing a hardener (Catalyst PL-3 manufactured by ShinEtsu, Chemical Co., Ltd.) in an amount of 0.5% relative to the resin amount. The resin coat was hardened at 150° C. for 5 minutes to form a silicone resin layer having a thickness of 0.2 μ. The thus obtained sheet was used as a printing plate.

Characters were recorded on this printing plate by using an electro discharge recording apparatus in the same way as in Example 1. The quality of the recorded characters was better than that in Example 1.

A commercially available black thermal ink-transfer sheet (manufactured by FUJI KAGAKUSHI KOGYO CO., LTD.) having a base film with a thickness of 9 μ was placed as an ink remover on the printing surface of the thus obtained printing plate. They were passed between a pressure roller and a heat roller having a diameter of 30 mm. The heat roller was rotated at a linear velocity of 3 cm/s, pressed toward the pressure roller at a linear pressure of 200 g/cm, and heated at about 100° C.

After the printing plate and the ink remover were cooled to room temperature (25° C.), a tension was applied to the printing plate to keep the printing plate flat, while the ink remover was peeled off along a metal roller having a diameter of 8 m. As the result, a printing plate having the ink adhered only to the image areas and the ink remover having no ink on the part corresponding to the image areas of the printing plate was obtained. A sheet of paper was placed on the printing plate, and they were passed between the heat roller and the pressure roller to transfer the ink on the image areas to the paper, whereby characters were clearly printed on the paper. Further, another sheet of paper was placed on the ink remover, and they were passed between the heat roller and the pressure roller to transfer the ink on the ink remover to the paper, whereby an image negative to the image areas of the printing plate was obtained on the paper.

EXAMPLE 5

By using a thermal ink-transfer sheet in the same way as in Example 4, an ink was applied to the printing plate that was produced in Example 4 and subjected to electric discharge recording.

Then, a transfer roller of nitrile rubber heated to 100° C. was brought in contact with the printing plate at a linear pressure of 50 g/cm thereby transferring the ink on the printing plate to the transfer roller. The transfer roller having the ink thereon was brought in contact with paper at a linear pressure of 200 g/cm thereby transferring the ink on the transfer roller to the paper. As the result, a printed image whose profile was clearer than that of Example 4 was obtained.

EXAMPLE 6

A commercially available black thermal ink-transfer sheet (manufactured by FUJIKKAGAKUSHI KOGYO Co., Ltd.) was placed as an ink remover on the printing surface of a commercially available dry lithographic printing plate (of a waterless lithographic positive type manufactured by Toray Industries, Inc.) that had been subjected to plate making. After they were heated on a hot plate that had been heated to about 100° C., they were removed from the hot plate to cool down to room temperature (25° C.).

When the ink remover was separated from the printing plate surface, the printing plate having the ink adhered only on the image areas was obtained.

Then a sheet of paper was placed on the printing plate, and they were placed on a hot plate. A linear pressure of about 100 g/cm was applied onto the paper by a roller of nitrile rubber. When the paper was removed from the printing plate, an image of the image areas of the printing plate was obtained on the paper.

EXAMPLE 7

A silicone rubber (KE45TS manufactured by Shin-Etsu Chemical Co., Ltd.) was applied on a polyethylene terephthalate film having a thickness of 25 μ, and hardened at room temperature to form an ink repelling silicone rubber layer having a thickness of about 2 μ. This film was used as a printing plate.

Then, the silicone rubber layer on the printing plate was removed partly by an edged tool whose tip was sharp to form image areas.

When, by using the printing plate, ink was applied to the printing plate in the same way s in Example 6, and was printed onto paper, an image of the image areas on the printing plate was obtained on the paper.

What is claimed is:

1. A method of forming an ink image comprising the steps of:
   - forming a printing plate having on a printing surface a part receptive to ink and a part capable of repelling ink;
   - placing an ink remover via a thermo-sensitive ink layer all of which is in a heated state on the printing surface of the printing plate; and
   - separating the printing plate and the ink remover after they are cooled so that the ink layer on the part capable of repelling ink is transferred to the ink remover.

2. A method of forming an ink image as claimed in claim 1, wherein said ink remover comprises a resin film.

3. A method of forming an ink image as claimed in claim 1, wherein the stem of placing the ink remover comprises the steps of: forming the thermo-sensitive ink layer on said ink remover; and placing the ink remover so that the thermo-sensitive ink layer is brought in contact with the printing surface of the printing plate.

4. A method of forming an ink image as claimed in claim 1, wherein said part capable of repelling ink comprises a silicone material.

5. A method of forming an ink image as claimed in claim 1, wherein said printing plate comprises an ink receptive support, an electro-conductive layer formed on one surface of the ink-receptive support, and an ink repelling layer formed on said electro-conductive layer, said ink repelling layer having been partly removed by electric discharge to form the part receptive to ink.

6. A method of forming an ink image as claimed in claim 1, wherein said printing plate has an ink repelling layer on an ink-receptive support, and said ink repelling layer is partly removed by mechanical means to form the part receptive to ink.

7. A method of forming an ink image as claimed in claim 1, wherein said printing plate has an ink repelling layer on an ink-receptive support, and said ink repelling layer is partly removed by irradiation of a high-energy density laser beam to form the part receptive to ink.

8. A printing method comprising the steps of:

forming a printing plate having on a printing surface a part receptive to ink and a part capable of repelling ink;

placing an ink remover via a thermo-sensitive ink layer, all of which is in a heated state on the printing surface of the printing plate;

separating the printing plate and the ink remover after they are cooled so that the ink layer on the part capable of repelling ink is transferred to the ink remover; and transferring an ink image obtained on the printing plate or the ink remover to an object.

9. A printing method as claimed in claim 8, wherein said ink remover comprises a resin film.

10. A printing method as claimed in claim 8, wherein the step of placing the ink remover comprises the steps of: forming the thermo-sensitive ink layer on said ink remover; and placing the ink remover so that the thermo-sensitive ink layer is brought in contact with the printing surface of the printing plate.

11. A printing method as claimed in claim 8, wherein the step of transferring the ink image comprises the steps of: transferring the ink image to a transfer medium; and transferring the ink image on said transfer medium to the object.

12. A printing method as claimed in claim 8, wherein said part capable of repelling ink comprises a silicone material.

13. A printing method as claimed in claim 8, wherein said printing plate comprises an ink-receptive support, an electro-conductive layer formed on one surface of the ink receptive support, an ink repelling layer formed on said electro-conductive layer, said ink repelling layer having been partly removed by electric discharge to form the part receptive to ink.

14. A printing method as claimed in claim 8, wherein said printing plate has an ink repelling layer on an ink-receptive support, and said ink repelling layer is partly removed by mechanical means to form the part receptive to ink.

15. A printing method as claimed in claim 8, wherein said printing plate has an ink repelling layer on an ink-receptive support, and said ink repelling layer is partly removed by irradiation of a high-energy density laser beam to form the part receptive to ink.

16. A printing method comprising the steps of:

forming a printing plate having on a printing surface a part receptive to ink and a part capable of repelling ink;

forming an ink sheet having a thermo-sensitive ink layer on an ink remover in the form of a sheet, placing said printing plate and said ink sheet on each other such that the thermo-sensitive ink layer of said ink sheet comes in contact with the printing surface of said printing plate while heating all of said ink sheet;

separating said printing plate and said ink remover after they are cooled so that the in layer on the part capable of repelling ink is transferred to the ink remover; and transferring an ink image obtained on said printing plate or said ink remover to an object.

17. A printing method as claimed in claim 16, wherein said ink remover comprises a resin film.

18. A printing method as claimed in claim 16, wherein the step of transferring the ink image comprises the steps of: transferring the ink image to a transfer medium and transferring the ink image on said transfer medium to said object.

19. A printing method as claimed in claim 16, wherein said part capable of repelling ink comprises a silicone material.

20. A printing method as claimed in claim 16, wherein said printing plate comprises an ink-receptive support, an electro-conductive layer formed on one surface of the ink-receptive support, and an ink repelling layer formed on said electro-conductive layer, said ink repelling layer having been partly removed by electric discharge to form the part receptive to ink.

21. A printing method as claimed in claim 16, wherein said printing plate has an ink repelling layer on an ink-receptive support, and said ink repelling layer is partly removed by mechanical means to form the part receptive to ink.

22. A printing method as claimed in claim 16, wherein said printing plate has an ink reveling layer on an ink-receptive support, and said ink repelling layer is partly removed by irradiation of a high-energy density laser beam to form the part receptive to ink.

* * * * *